US007395556B2

(12) United States Patent
Eraca

(10) Patent No.: US 7,395,556 B2
(45) Date of Patent: Jul. 8, 2008

(54) LABOR AND DELIVERY OUTFIT

(76) Inventor: Jennifer A. Eraca, 32 Brown Rd., Pleasant Valley, NY (US) 12569

( * ) Notice: Subject to any disclaimer, the term of this patent is extended or adjusted under 35 U.S.C. 154(b) by 0 days.

(21) Appl. No.: 11/432,104

(22) Filed: May 12, 2006

(65) Prior Publication Data

US 2007/0271675 A1 Nov. 29, 2007

(51) Int. Cl.

| | |
|---|---|
| ***A41D 1/20*** | (2006.01) |
| ***A41B 9/00*** | (2006.01) |
| ***A41B 1/18*** | (2006.01) |
| ***A41B 1/08*** | (2006.01) |
| ***A41C 3/08*** | (2006.01) |

(52) U.S. Cl. ..... 2/104; 2/114; 2/118; 2/121; 2/211; 2/221; 450/30; 450/31

(58) Field of Classification Search ..... 2/104, 2/114, 115, 211, 221, 105, 106, 109, 110, 2/118, 121; 450/30, 31, 36
See application file for complete search history.

(56) References Cited

U.S. PATENT DOCUMENTS

| | | | | | |
|---|---|---|---|---|---|
| 818,351 | A | | 4/1906 | Clark | |
| 974,981 | A | | 11/1910 | Lee | |
| 1,766,272 | A | | 6/1930 | Vallier | |
| 1,998,051 | A | | 4/1935 | Gerber | |
| 2,079,656 | A | * | 5/1937 | Mirsky | 450/31 |
| 2,269,755 | A | * | 1/1942 | Black | 450/31 |
| 2,319,089 | A | * | 5/1943 | Severance | 2/114 |
| 2,493,179 | A | * | 1/1950 | Wittenberg | 450/32 |
| 2,530,829 | A | * | 11/1950 | Licht | 450/52 |
| 2,601,679 | A | * | 7/1952 | Garnett | 450/34 |
| 2,638,597 | A | * | 5/1953 | Troxell | 2/74 |
| 2,701,363 | A | * | 2/1955 | Roodner | 2/73 |
| 2,703,884 | A | * | 3/1955 | Roth | 450/3 |
| 2,707,282 | A | * | 5/1955 | Paterson | 2/114 |
| 2,722,011 | A | * | 11/1955 | Maines | 2/76 |
| 2,787,792 | A | * | 4/1957 | Mikottis | 2/221 |
| 2,854,006 | A | * | 9/1958 | Geimer | 450/117 |
| 3,176,692 | A | * | 4/1965 | Marino | 450/30 |
| 3,276,036 | A | | 10/1966 | Cater | |
| 3,449,763 | A | * | 6/1969 | Grate | 2/73 |
| 3,505,685 | A | * | 4/1970 | Granchelli | 2/221 |
| 3,611,439 | A | * | 10/1971 | Meyers | 2/54 |
| 3,877,078 | A | * | 4/1975 | Tepper | 2/74 |
| 4,280,229 | A | * | 7/1981 | Stein | 2/221 |
| 4,458,365 | A | * | 7/1984 | Wood | 2/104 |
| 4,590,624 | A | * | 5/1986 | Weiser | 2/114 |
| 4,648,404 | A | * | 3/1987 | Clark | 450/31 |
| D295,112 | S | * | 4/1988 | Viola | D2/851 |

(Continued)

*Primary Examiner*—Gary L. Welch
*Assistant Examiner*—Jena A Sold
(74) *Attorney, Agent, or Firm*—Joseph L. Spiegel; Heslin Rothenberg Farley & Mesiti PC

(57) ABSTRACT

A labor and delivery outfit designed to provide function, comfort and dignity, comprises: a sleeveless, wrap shirt having an upper portion with nursing flaps, lower portions extending from the flaps, a back having straps, lower portions defining an opening therebetween; a built-in, supporting, nursing bra with nursing cups, releasable fasteners for covering the nursing cups, and, a wrap skirt having an elastic waist, a built-in pregnancy panel, and, a rear zipper. Releasable fasteners are provided for fastening the rear lower portions to the upper portion of the shirt, thereby providing access to the spine.

6 Claims, 5 Drawing Sheets

U.S. PATENT DOCUMENTS

| | | | | |
|---|---|---|---|---|
| 4,759,083 | A | 7/1988 | Belcher | |
| 4,964,173 | A | 10/1990 | Gordon et al. | |
| 5,062,159 | A | 11/1991 | Jakub | |
| 5,088,117 | A * | 2/1992 | Fulmer | 2/114 |
| 5,133,086 | A | 7/1992 | Truitt et al. | |
| D336,968 | S | 7/1993 | Russano | |
| 5,440,763 | A * | 8/1995 | Shah et al. | 2/114 |
| 5,461,725 | A * | 10/1995 | Witczak | 2/104 |
| 5,768,707 | A * | 6/1998 | Lederer | 2/114 |
| 5,913,407 | A * | 6/1999 | Keyes | 2/83 |
| 6,206,005 | B1 * | 3/2001 | Keyes | 128/898 |
| 6,460,188 | B1 * | 10/2002 | Hatton | 2/114 |
| 6,792,622 | B2 | 9/2004 | Graves | |
| 6,854,132 | B1 * | 2/2005 | Polzin | 2/104 |
| 6,983,489 | B2 * | 1/2006 | Caprio | 2/69 |
| 7,181,775 | B2 * | 2/2007 | Carney | 2/311 |
| 2004/0038621 | A1 * | 2/2004 | Vera | 450/36 |
| 2004/0143885 | A1 * | 7/2004 | Rothman | 2/104 |
| 2004/0166766 | A1 * | 8/2004 | Schneider et al. | 450/36 |
| 2005/0085160 | A1 * | 4/2005 | Johnstone | 450/36 |
| 2006/0031976 | A1 * | 2/2006 | Nwawka | 2/114 |
| 2008/0000004 | A1 * | 1/2008 | Lucock | 2/104 |

* cited by examiner

LABOR AND DELIVERY OUTFIT

BACKGROUND OF THE INVENTION

1. Field of the Invention

This invention relates to women's clothing and, in particular, to an outfit to be worn by a woman at the time of labor and delivery of an infant.

2. Description of the Prior Art

In the past, little attention has been paid to the clothing worn by women while laboring and delivering an infant, to provide comfort, function and dignity. Some prior art examples may be found in U.S. Pat. Nos. 818,351; 974,981; 4,759,083; 4,964,173; 5,062,159; 5,133,086; 5,913,407; Des. 336,968; and, 6,792,622. Very little attention is paid to gowns specifically designed for use by pregnant women who are in labor and giving birth. Some are too long, cumbersome, open in the back and provide no breast support.

SUMMARY

An object of the invention is an outfit designed to provide function, comfort and dignity while laboring and delivering an infant.

Another object of the invention is a labor and delivery outfit that will improve the mental status and comfort of the mother wearing the outfit.

Still another object is to make the birthing process as humane and dignified as possible while providing, support and discretion to the mother.

A further object is a labor and delivery outfit that, in addition to the aforementioned advantages, allows easy access to the perineal and spinal areas for medical staff for labor specific exams and treatment.

These and other objects, features and advantages are accomplished in accordance with the teachings of the present invention, one illustrative embodiment of which comprises a labor and delivery outfit designed to provide function, comfort and dignity, comprising: a sleeveless, wrap shirt having an upper portion that includes a right nursing flap, and a left nursing flap, a first lower portion extending from the right nursing flap, a second lower portion extending from the left nursing flap, a back having a right strap, a left strap, and overlapping right rear lower portion and left rear lower portion defining an opening therebetween; a bra, preferably a built-in, supporting, nursing bra having a first section extending between the right strap and the first lower portion and including a right breast nursing cup, and having a second section extending between the left strap and the second lower portion and including a left breast nursing cup, releasable means for fastening the right nursing flap to the right strap, thereby covering the right nursing cup, and releasable means for fastening the left nursing flap to the left strap, thereby covering the left nursing cup; and, a wrap skirt having an elastic waist, a built-in pregnancy panel, and, a rear zipper. The nursing flaps of the shirt in closed position may form a V-neck. The back may be shaped in a V. A seam is provided between the upper portion and lower portions. Releasable means are provided for fastening the rear lower portions to the upper portion of the shirt, thereby providing access to the spine.

BRIEF DESCRIPTION OF THE DRAWING

Other objects, features and advantages of the present invention will be apparent from the following detailed description and accompany drawing, wherein.

DETAILED DESCRIPTION

Figure 1:
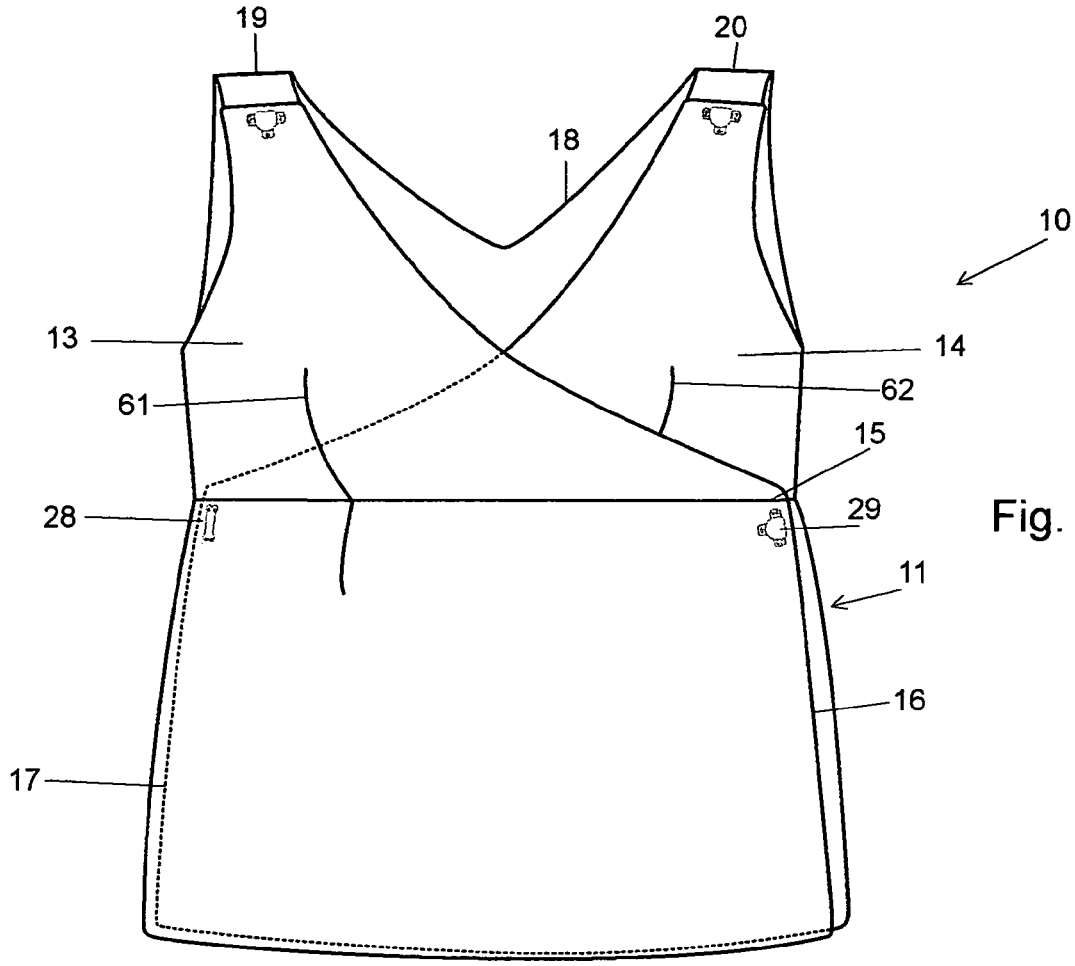
FIG. 1 is a front view of the shirt of the labor and delivery garment of the present invention as it would appear when worn by a pregnant woman.

Referring now to the drawing, the labor and delivery outfit 10 of the present invention is seen as including a shirt 11 and skirt 12. The outfit can be made from a cotton/polyester blend, spandex, etc., to allow for quick drying and breathability.

Figure 4:
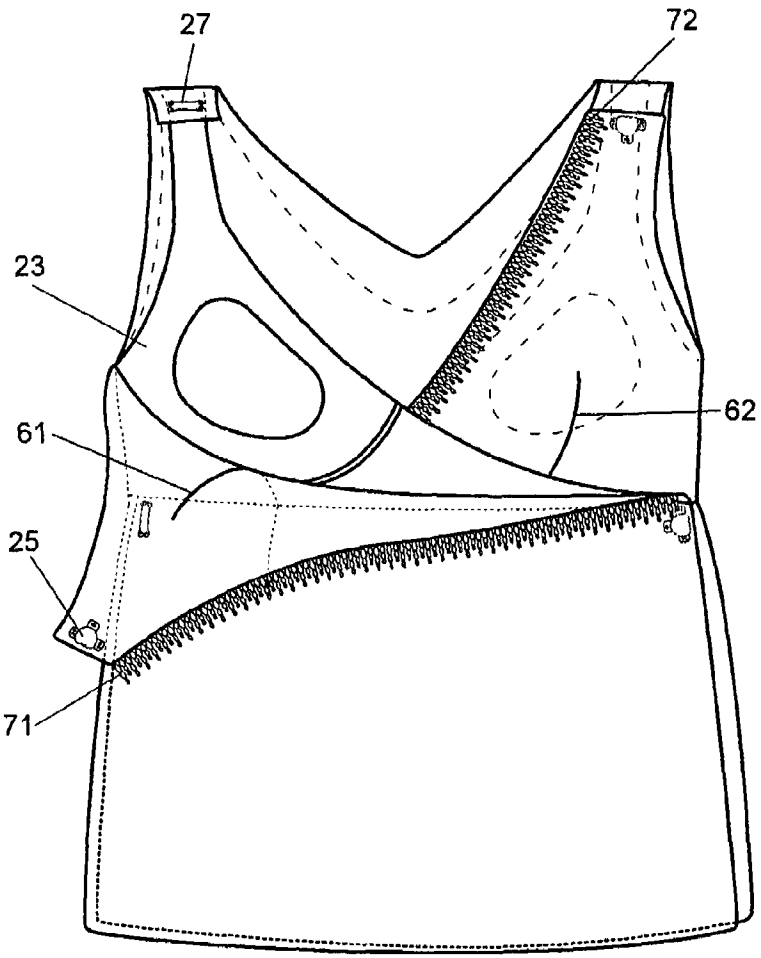
FIG. 4 is a front view of the shirt with the right breast flap opened.
Figure 3:
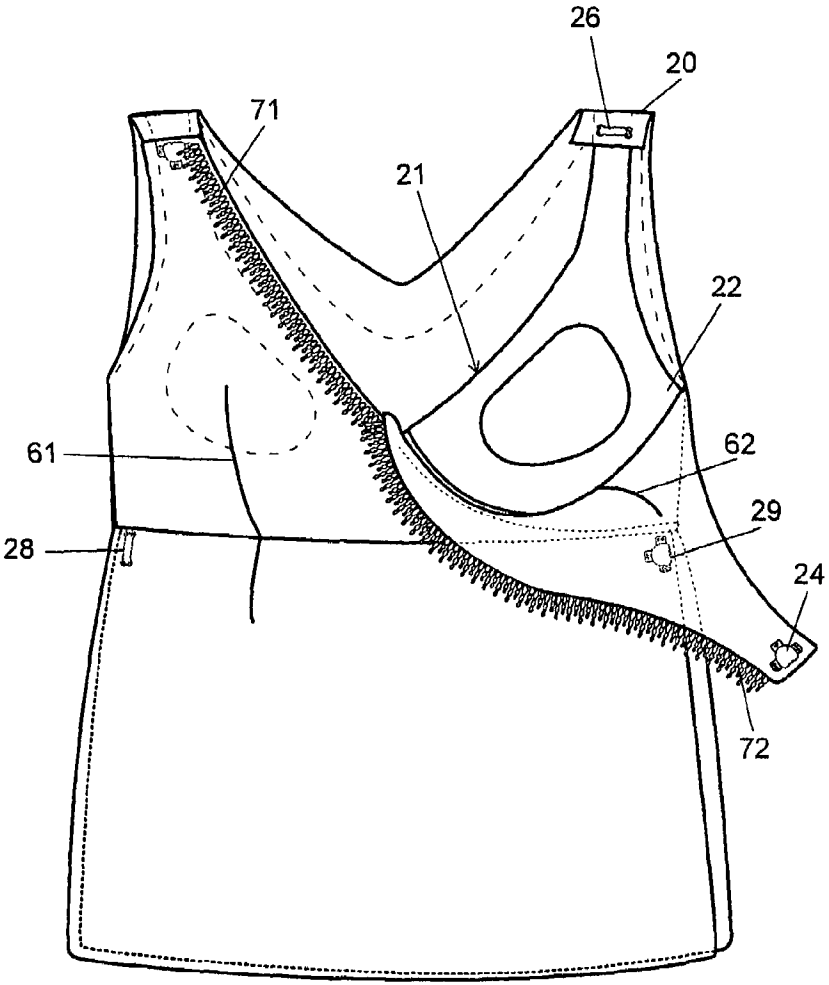
FIG. 3 is a front view of the shirt with the left breast flap opened.

With reference to FIGS. 1, 3 and 4, shirt 11 comprises: an upper front portion that includes a right nursing flap 13 and left nursing flap 14; seam 15; a first lower portion 16 extending from the right nursing flap 13; a second lower portion 17 extending from the left nursing flap 14; back 18 that includes right strap 19 and left strap 20; a bra, preferably a built-in bra 21 having a second section extending between the left strap 20 and the second lower portion 17 and including left breast nursing cup 22 and having a first section extending between the right strap 19 and the first lower portion 16 and including a right breast nursing cup 23. The bra sections are affixed to the straps and lower sections as by stitching. The flaps 13,14 are so shaped as to provide a V-neck while the rear piece 18 is cut so as to provide, preferably, a V-back.

Flaps 13,14 are provided with fastening devices, for example, eyes 24, 25 and hooks 26,27, so that the flaps 13,14 may be engaged and then disengaged when nursing a baby. Other fastening devices could be used such as snaps, buttons, etc. The shirt 11 is also provided with fastening devices at 28,29 at the top of the lower portions 16,17 for unwrapping the shirt 11.

By unsnapping one or the other flap fastening devices, a breast is exposed for nursing. By unsnapping the lower portion fastening devices 28,29, the shirt may be taken off. The seam 15 provides support and gives contour to the nursing bra unit.

Figure 2:
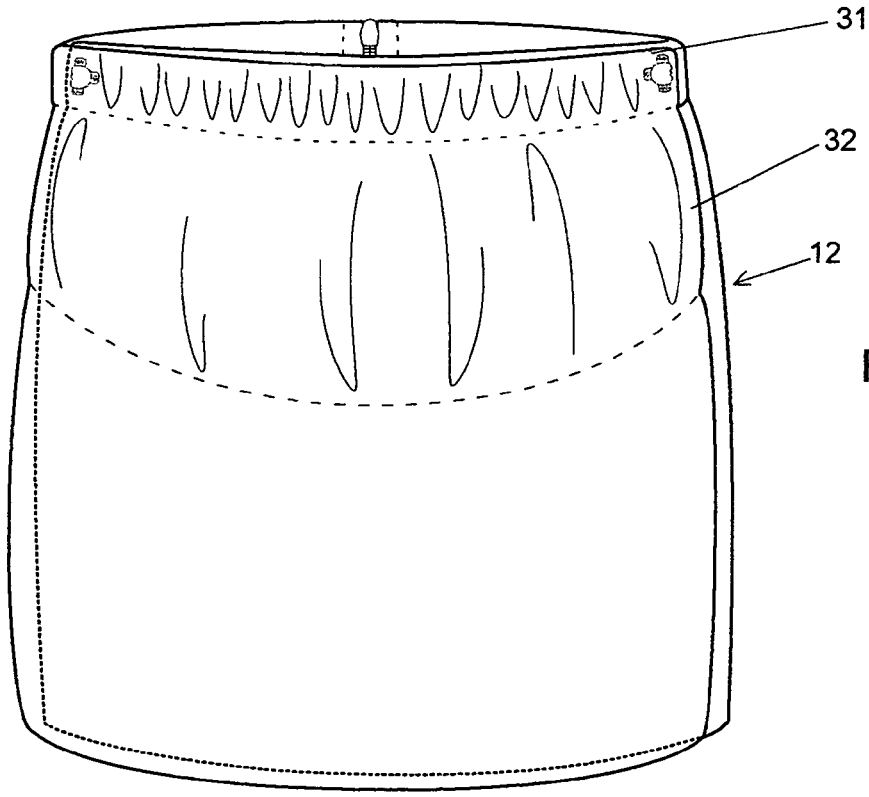
FIG. 2 is a front view of the skirt of the labor and delivery garment of the present invention as it would appear when worn by a pregnant woman.

In FIG. 2 the garment's wrap skirt 12 is depicted. Skirt 12 is provided with an elastic waist 31, a pregnancy panel 32 and a zipper 33 at the rear (See FIG. 8). The pregnancy panel 32 includes extra, stretchable fabric sewn into the front pelvic region, and allows for surrounding and covering the abdomen and providing support and is tapered from the waist 31 down to give the woman some contour to her body.

Figure 5:
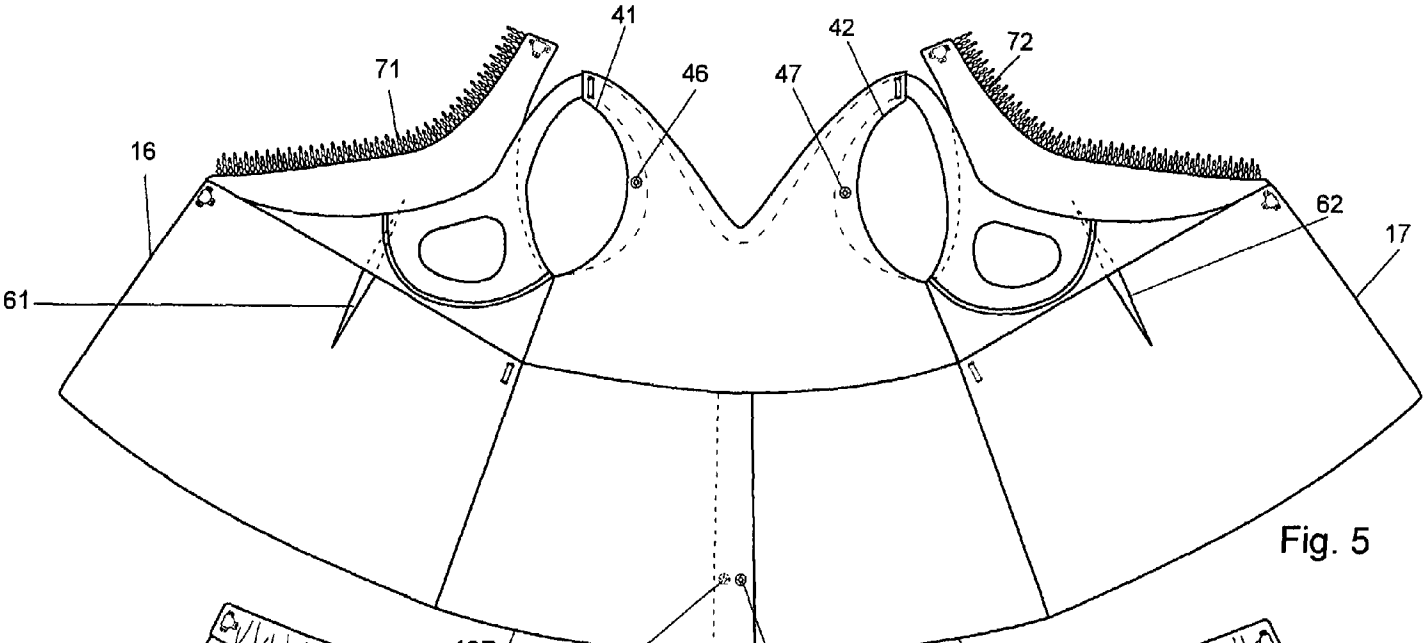
FIG. 5 is a front view of the shirt laid open showing the interior of the shirt.

FIG. 5 shows the shirt laid open showing the interior of the shirt and illustrating the positioning of the arm-holes 41,42. Also illustrated are the rear lower portions 16R and 17R.

Lower portions 16R and 17R overlap leaving a vertical slit at 43. The overlap is on the order of two inches. The opening or slit provides access for a doctor to administer any kind of anesthesia into the spine. The ends of the lower portions 16R and 17R are provided with snaps 44,45 near their edges. The upper portion of the shirt is provided with snaps at 46,47. The lower portions 16R, 17R may be held in open position (FIG. 9) by fastening snaps 44,45 to upper snaps 46, 47, respectively. Other fastening type devices may be used as well such as hooks.

Figure 6:
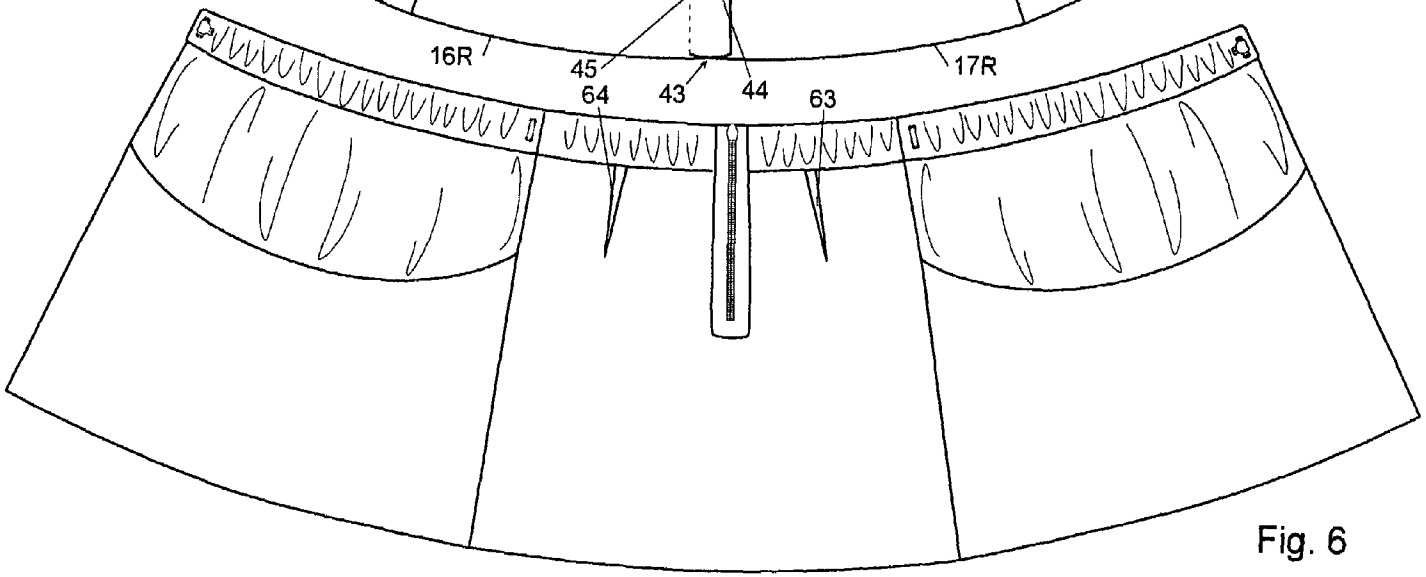
FIG. 6 is a front view of the skirt laid open showing the interior of the skirt.

FIG. 6 shows the skirt 12 laid open showing the interior of the skirt.

Figure 7:
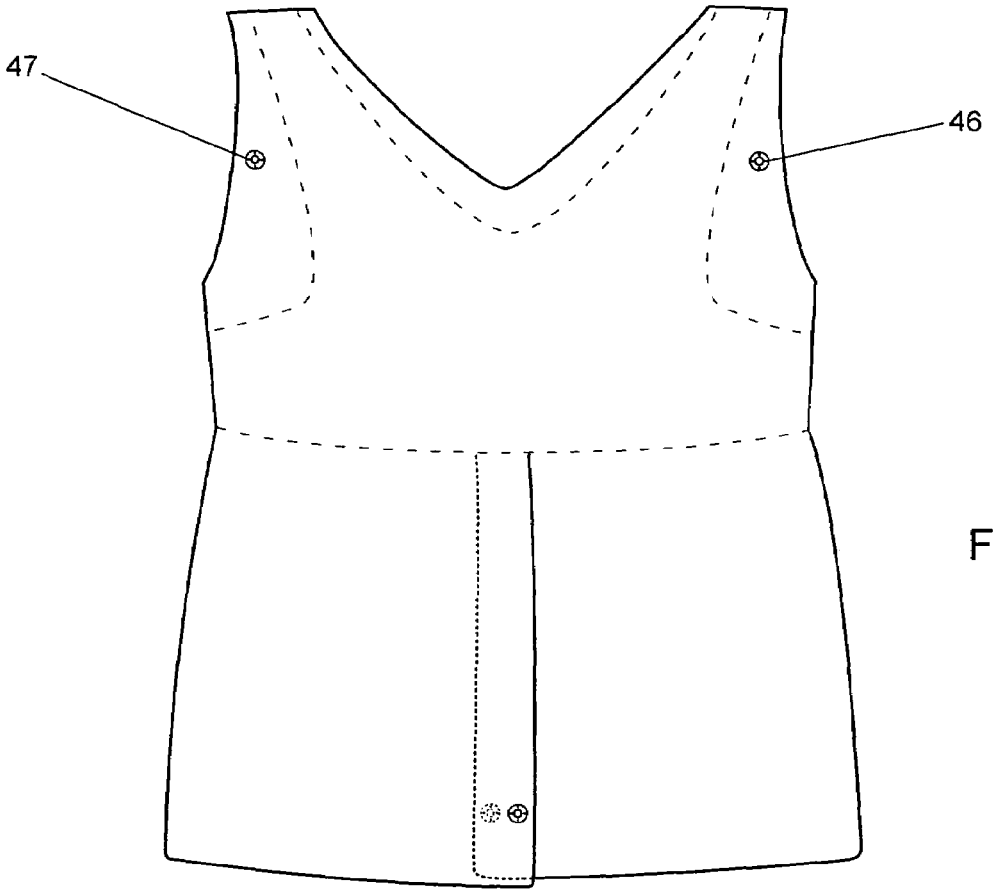
FIG. 7 is a rear view of the shirt when being worn.

FIG. 7 is a rear view of the shirt 11 as it would appear when being worn and shows, in phantom, the rear of the nursing bra.

Figure 8:
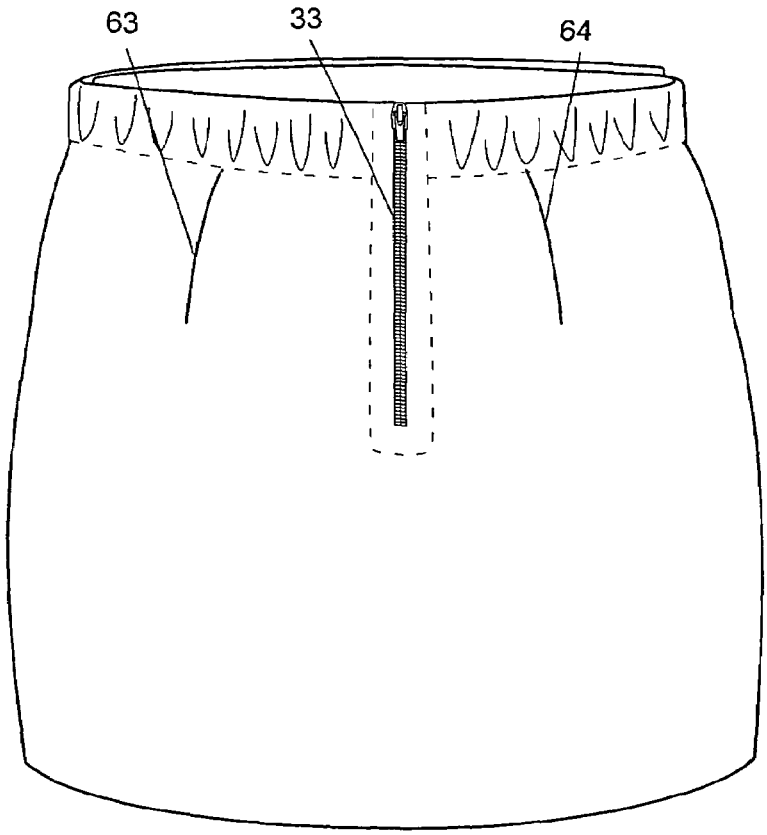
FIG. 8 is a rearview of the skirt when being worn.

FIG. 8 is a rear view of the skirt as it would appear when being worn.

Figure 9:
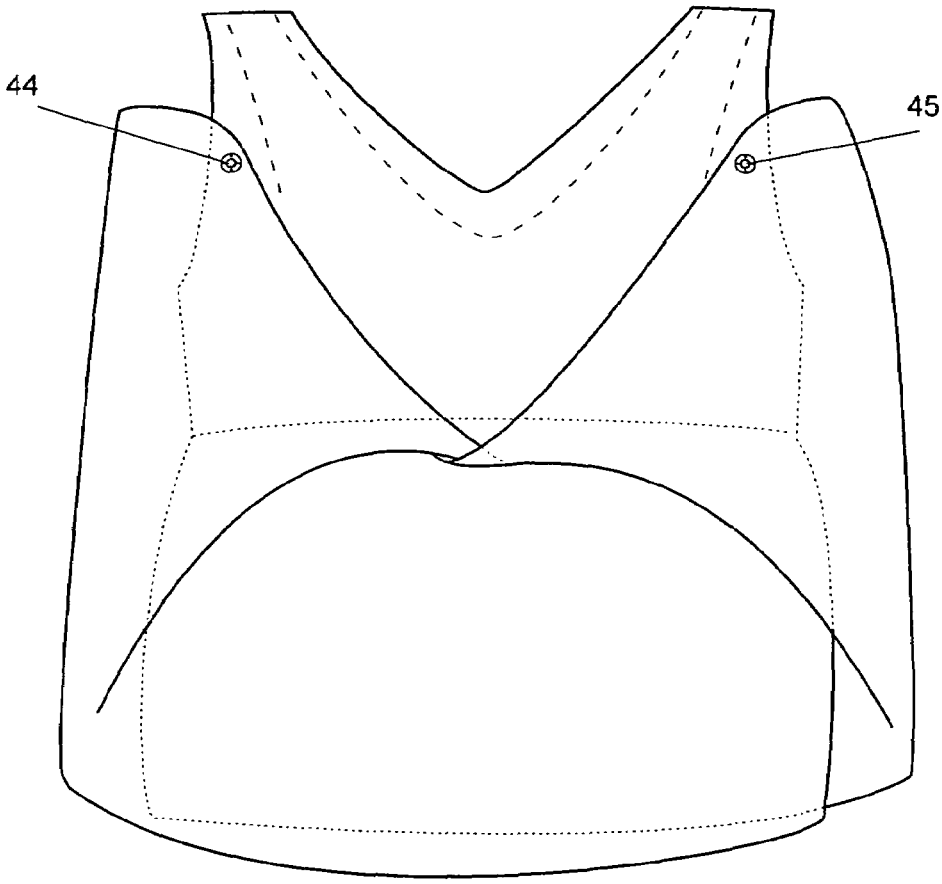
FIG. 9 is a rear view of the shirt when being worn with rear lower portions folded back; and, FIG. 10 is a rearview of the skirt when being worn, but un-zippered.

FIG. 9 shows the rear of the shirt 11 in open position for easy access by the nursing staff or physician.

Figure 10:
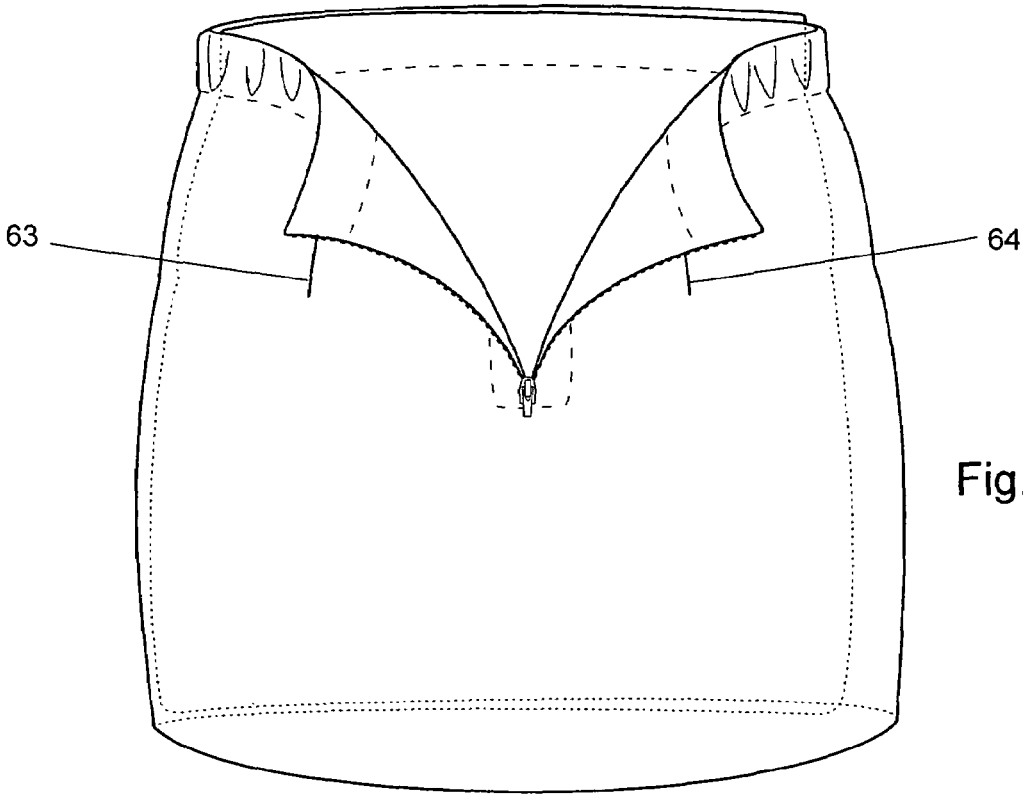

FIG. 10 shows the rear of the skirt, un-zippered, to allow access to the lower portion of the woman's spine.

The garment is provided with darts at 61,62 (FIGS. 1,3,4, 5), 63,64 (FIGS. 6, 8) sewn into the garment to add shape to the garment.

In use, the outfit is seen as a tapered fitting garment designed to provide function, comfort and dignity while laboring or delivering an infant. Its design allows for a touch of a trendy fashion resembling more of a casual outfit than a hospital gown or pajamas.

The tapered fitting of the garment means it wears close to the body yet allows breathability and comfort. It is not clingy but rests, lays or conforms to the pregnant woman's body while allowing her not to feel constricted. This is in contrast to prior art maternity clothes that are known for being roomy or bulky thus making a woman feel larger than she is.

It allows a woman to labor and walk around a maternity ward and not feel exposed as compared with a hospital gown which is one size fits all and is wide open in the back. Having a sleeveless top with a V-neck and V-back allows for breathability and body temperature comfort, while affording medical access to the heart/chest area. Being sleeveless, it offers easy access to veins/arms needed for IV tubing. The shirt's built-in bra/nursing bra affords the mother breast support while she is laboring as well as dignity if she is walking around the maternity ward. Its open back slit not only provides access to the spine as needed by the medical staff but also provides comfort to the mother wearing it. In prior art garments, the snaps are large and along the spinal column making it an uncomfortable feature while lying on one's back, especially if a woman is experiencing back labor and is not opting for pain medication. It is also cumbersome to snap them back into place while a woman is laboring. Traditional johnnys that women have worn in the past tie in the back and the knots and are also uncomfortable.

The outfit of the present invention may also provide a touch of whimsy by adding beading and/or decorative trim along the V-neck and seams (71,72 in FIGS. 3-5).

The skirt simply falls open for access to the abdomen/perineal area because of the wrap skirt feature or can be unhooked and/or unsnapped at the respective pelvic/hip sides. All necessary monitoring devices can be easily placed and/or accessed on the mother while still maintaining the privacy and dignity of the patient as well as the garment. The comfortable/expandable elastic waist avoids pulling or constricting a woman's abdominal area, yet still quickly and easily opens exposing the abdominal/perineal area.

It should be obvious that changes, additions and omissions may be made in the details and arrangement of parts without departing from the spirit and scope of the invention as hereinafter claimed.

What is claimed is:

1. A labor and delivery outfit designed to provide function, comfort and dignity, comprising:

a wrap shirt having
- an upper portion that includes
  - a right flap, and
  - a left flap,
- a bra covered by the flaps,
- a first lower portion extending from the right flap,
- a second lower portion extending from the left flap,
- a back having
  - a right strap,
  - a left strap, and
  - overlapping right rear lower portion and left rear lower portion
  - defining an opening therebetween and,
- the bra comprising
  - a supporting, nursing bra affixed to the wrap shirt, having
  - a first section extending between the right strap and the first lower
  - portion and including a right breast nursing cup,
  - a second section extending between the left strap and the second
  - lower portion and including a left breast nursing cup,
  - releasable means for fastening the right flap to the right strap,
  - thereby covering the right nursing cup, and,
  - releasable means for fastening the left flap to the left strap, thereby
  - covering the left nursing cup; and, a separate wrap skirt having
- an expandible waist,
- a pregnancy panel that includes extra, flexible fabric sewn into the pelvic region for surrounding and covering the abdomen, and,
- a rear zipper for providing access to the lower spine.

2. The outfit of claim 1 wherein the flaps in closed position form a V-neck.

3. The outfit of claim 1 wherein the back is shaped in a V.

4. The outfit of claim 1 including a seam between the upper portion and lower portions.

5. The outfit of claim 1 including releasable means for fastening the rear lower portions to the upper portion of the shirt, thereby providing access to the spine.

6. The outfit of claim 1 wherein the shirt is sleeveless.

* * * * *